United States Patent [19]

Cooper

[11] 4,248,586

[45] Feb. 3, 1981

[54] GAS BURNERS

[75] Inventor: Charles F. Cooper, Worcester, England

[73] Assignee: J. Tennant & Sons (Warrington) Limited, England

[21] Appl. No.: 959,170

[22] Filed: Nov. 9, 1978

[30] Foreign Application Priority Data

May 31, 1978 [GB] United Kingdom ..... 33344/78

[51] Int. Cl.[3] ..... F23D 13/12

[52] U.S. Cl. ..... 431/328

[58] Field of Search ..... 431/328, 329

[56] References Cited

U.S. PATENT DOCUMENTS

| | | | |
|---|---|---|---|
| 3,170,504 | 2/1965 | Lanning | 431/328 |
| 3,407,024 | 10/1968 | Hirschberg et al. | 431/328 |

*Primary Examiner*—Carroll B. Dority, Jr.

*Attorney, Agent, or Firm*—Larson, Taylor and Hinds

[57] ABSTRACT

A casing for supporting a radiant refractory panel for surface-combustion heating, in the form of an open-topped ceramic box providing for admission of air and combustible gas as such or as a mixture, the panel being secured by an adhesive-bound glass or other refractory fibre wrapped to cover the join between panel and casing.

2 Claims, 8 Drawing Figures

0 10 20 30 mm

GAS BURNERS

This invention relates to gas burners of the kind comprising a surface-combustion radiant plate or panel of refractory material, such as a bonded refractory ceramic fibre or a solid refractory, being porous or having passages therethrough for a gas/air mixture to burn at the surface of the panel which glows as a radiant heater for space heating and other domestic or industrial purposes.

It has been usual to mount such radiant panels on metal casings to the interior of which gas or gas/air mixture is supplied to pass through and burn at the faces of the panels forming fronts or closures for the casings.

Metal casings are relatively expensive, especially if special internal shaping should be required, and they can also involve operational difficulties such as through differential expansion with refractory ceramic components.

According to an invention of John Douglas Martin, subject of an application being filed contemporaneously with the present application, casings for supporting radiant panel burners are made, in the form of open-topped boxes, from a refractory ceramic material. In a preferred manner of use of such casings the radiant panel is mounted, as a lid, on such a refractory box and secured by refractory mortar, cement, adhesive or other ceramic means so as to make up a radiant panel burner unit which can if required consist entirely of refractory ceramic material.

I have found that a particularly desirable and satisfactory heater unit is given if an adhesive-bound glass or other refractory fibre is wrapped to cover and seal the join between panel and housing, to increase the strength of the bond given by the mortar or the like or to form the join on its own. Such a heater is completely secured against separation of panel and casing in handling and in service.

Boxes of simple shape can be made very economically by dry or semi-dry pressing of a suitable refractory ceramic material, such as fireclay, and special internal shapes can be provided by in-situ moulding and/or separately-made components secured in the boxes by refractory cement, mortar or slip.

Internal shaping of the refractory boxes may provide for baffling or guiding the flow, or effecting mixing, of a gas/air mixture supplied as gas which entrains air, as through a venturi injector, or as a pre-mixture of gas and air.

The accompanying drawings show a housing and burner plate by way of example, and in them:

Figure 1:
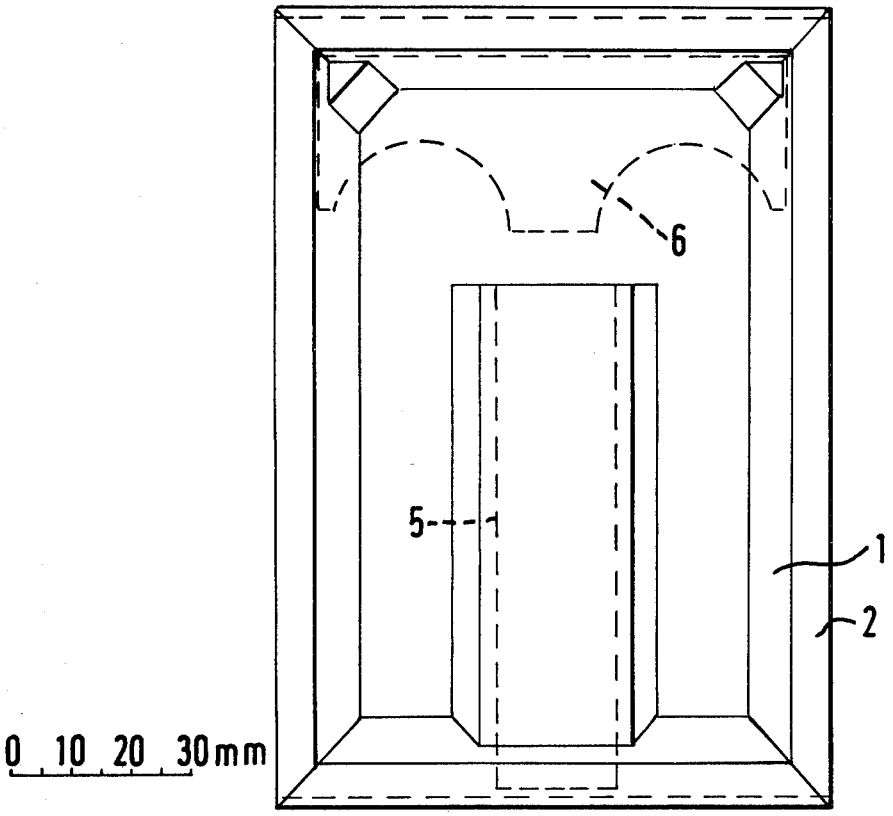
FIG. 1 is a plan view of the housing.
Figure 2:
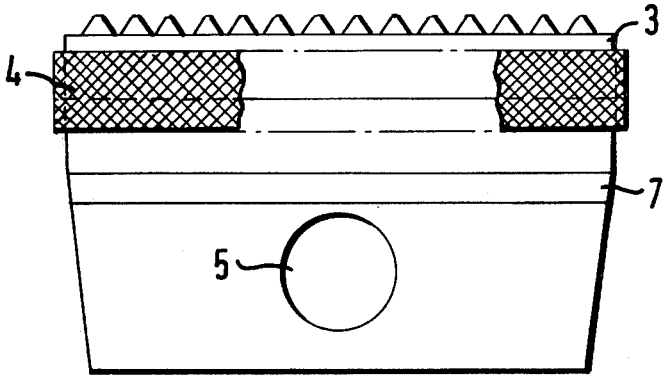
FIG. 2 is an end view of the housing and burner plate with joining tape applied.
Figure 3:
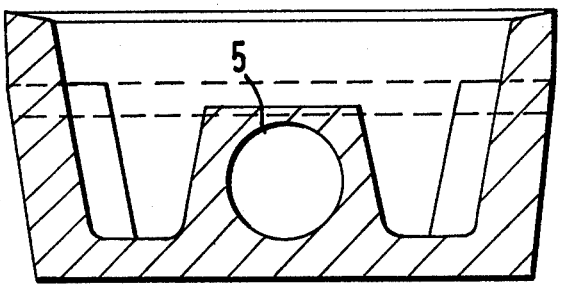
FIG. 3 is a sectional elevation taken across FIG. 1.
Figure 4:
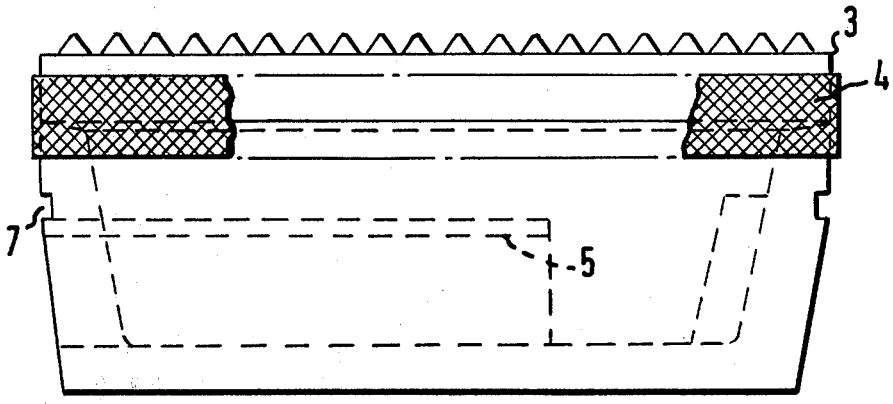
FIG. 4 is a side view corresponding to FIG. 2.
Figure 5:
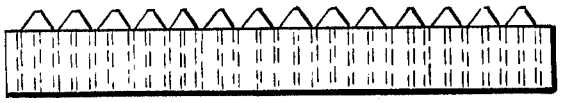
FIG. 5 is an end view of the burner plate.
Figure 6:
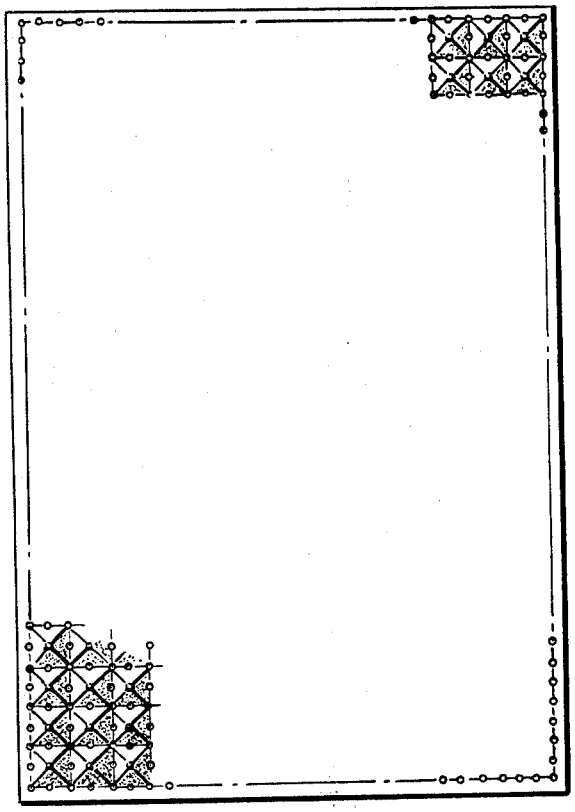
FIG. 6 is a diagrammatic plan view of the burner plate.
Figure 7:
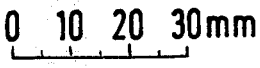
FIGS. 7 and 8 are plan and end views of a baffle.
Figure 7:
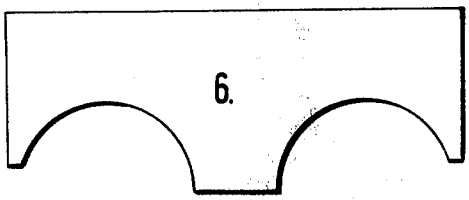
Figure 8:
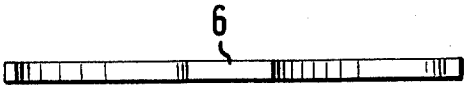

The drawings largely speak for themselves. The housing is a box 1 with a chamfered edge 2 that receives a layer of cement on which the burner plate 3 is bedded. Refractory adhesive bonded glass fibre tape 4 completes the joint. Gas and air enter via a venturi or other gas or gas/air supply fitting opening 5, and are guided by the baffle 6 which is cemented in place. Mounting grooves 7 are provided for the assembly as a whole.

The glass fibre tape used is a standard commercial medium weave tape 19 mm wide and 0.18 mm thick, and capable of withstanding a temperature of 400° to 500° C. if required. In practice much lower temperatures are usual. The tape is bonded with a proprietary refractory cement impregnating the tape and bonding the fibres both within the tape and to the box and the burner plate. An alternative is a strip of alumino silicate fibre paper such as 'Triton Kaowool' paper, made of blown alumino silicate fibres based on high purity china clay, of 43 to 47 weight % alumina content and 50 to 54 weight % silica content. Such fibres may be bonded by an aqueous sodium silicate adhesive.

The burner plate or plaque itself is generally of known multi-pyramid form, with gas/air passages where the corners of the pyramids meet and half way along the groove between each pair of faces, as disclosed for example in U.S. Pat. No. 3,954,387, which disclosure is incorporated herein by reference.

Single inlet boxes or multi-inlet boxes may be provided, with a single burner plate covering both sections. Each section is then like the single boxes shown in the drawings but with for example longer walls in common between adjacent sections.

I claim:

1. A heater comprising a radiant refractory panel for surface combustion of gas and air passing through the panel, mounted as a lid on a casing in the form of an open-topped ceramic box providing for admission of air and combustible gas as such or as a mixture, said mounting being such that the outer circumferential surfaces of said panel and the open-topped ceramic box define between them an outer circumferential side join about the circumference of the heater, wherein the panel is secured by an adhesive-bound glass or other refractory fibre wrapped onto said outer circumferential surfaces to cover and seal the circumferential side join between panel and casing.

2. A heater according to claim 1, wherein the fibre is used in conjunction with a refractory mortar, cement or adhesive between the opposing faces of the panel and the casing.

* * * * *